US006918259B2

(12) United States Patent
Anderson et al.

(10) Patent No.: US 6,918,259 B2
(45) Date of Patent: Jul. 19, 2005

(54) AIR CIRCULATION AND FILTRATION SYSTEM FOR A REFRIGERATOR

(76) Inventors: Troy M. Anderson, 2270 Copper Dr., Marion, IA (US) 52302; Gregory S. Carr, 20 Cougar Pl., North Liberty, IA (US) 52317; James H. Jenkins, Jr., 402 Q St., South Amana, IA (US) 52334; Mark W. Mooberry, 3300 Brook View Dr., Des Moines, IA (US) 50317; Todd E. Pritts, 2624 Summerwood Ct. SW., Cedar Rapids, IA (US) 52404; Todd J. Tunzi, 3191 122nd St., Amana, IA (US) 52203; Dennis E. Winders, 6019 Langdon Ave. SW., Cedar Rapids, IA (US) 52404

( * ) Notice: Subject to any disclaimer, the term of this patent is extended or adjusted under 35 U.S.C. 154(b) by 0 days.

(21) Appl. No.: 10/630,831

(22) Filed: Jul. 31, 2003

(65) Prior Publication Data

US 2005/0022549 A1 Feb. 3, 2005

(51) Int. Cl.[7] ..... F24F 3/16

(52) U.S. Cl. ..... 62/78; 62/187; 471/313; 471/423.9

(58) Field of Search ..... 62/78, 126, 404, 62/407, 408, 314, 419, 426, 186, 187, 264, 389, 391, 239; 417/313, 423.14, 423.9; 222/2, 113, 146.6, 413; 141/379, 391

(56) References Cited

U.S. PATENT DOCUMENTS 3,659,429 A * 5/1972 McLean ..... 62/157
3,747,361 A * 7/1973 Harbour ..... 62/157
4,834,169 A * 5/1989 Tershak et al. ..... 165/233
5,256,159 A * 10/1993 Newman ..... 604/317
5,729,997 A 3/1998 Witsoe
5,901,562 A * 5/1999 Tunzi et al. ..... 62/229
5,921,104 A * 7/1999 Chang ..... 62/407
6,070,419 A 6/2000 Chang
6,119,468 A 9/2000 Seok
6,138,460 A 10/2000 Lee
6,170,276 B1 * 1/2001 Mandel et al. ..... 62/187
6,223,553 B1 * 5/2001 Albert et al. ..... 62/407
6,457,955 B1 * 10/2002 Cheng ..... 417/423.8
6,543,249 B2 * 4/2003 Kim et al. ..... 62/407
6,604,377 B2 * 8/2003 Watanabe et al. ..... 62/408
6,612,116 B2 * 9/2003 Fu et al. ..... 62/3.6
6,679,073 B1 * 1/2004 Hu ..... 62/135
6,725,680 B1 * 4/2004 Schenk et al. ..... 62/186
6,735,976 B2 * 5/2004 Lee ..... 62/419
6,739,146 B1 * 5/2004 Davis et al. ..... 62/155
6,742,855 B2 * 6/2004 Whitaker et al. ..... 312/405.1

FOREIGN PATENT DOCUMENTS

JP 409152247 A * 6/1997
JP 410026458 A * 1/1998
JP 410038433 A * 2/1998

* cited by examiner

*Primary Examiner*—Harry B. Tanner
*Assistant Examiner*—Mohammad M. Ali
(74) *Attorney, Agent, or Firm*—Diederiks & Whitelaw, PLC; Kirk W. Goodwin

(57) ABSTRACT

A refrigerator includes a fresh food stirring fan assembly arranged within a fresh food compartment. The stirring fan assembly functions to recirculate air in order to minimize temperature stratification in the fresh food compartment. The stirring fan assembly preferably incorporates a filter to remove airborne debris and absorb odors. In accordance with one preferred embodiment of the invention, the fresh food stirring fan is operated whenever a damper controlling an inlet flow of cooling air to the fresh food compartment is in a closed position.

26 Claims, 6 Drawing Sheets

AIR CIRCULATION AND FILTRATION SYSTEM FOR A REFRIGERATOR

BACKGROUND OF THE INVENTION

1. Field of the Invention

The present invention pertains to the art of refrigerated appliances and, more particularly, to a refrigerator including a fresh food compartment stirring fan assembly for establishing a substantially uniform compartment temperature, with the stirring fan assembly including a removable filter for eliminating odors and other contaminants within the appliance.

2. Discussion of the Prior Art

In general, a refrigerator includes a first or freezer compartment for maintaining foodstuffs at or below freezing, and a second or fresh food compartment, in fluid communication with the freezer compartment, for maintaining foodstuffs in a temperature zone between ambient and freezing temperatures. A typical refrigerator includes a refrigeration system including a compressor, an evaporator, a condenser, a main cooling fan for developing a flow of cold air, and a damper located in a passageway interconnecting the freezer and fresh food compartments. In operation, one or more temperature sensors provided within the refrigerator measure at least one internal refrigerator compartment temperature. When the internal temperature of the refrigerator deviates from a predetermined set point temperature, the refrigeration system operates to return the temperature to a point below the set-point.

In general, the largest temperature deviations occur in the freezer compartment. Due to the low temperature at which the freezer compartment is maintained, changes in the freezer compartment, resulting from door openings, ambient temperature changes or the like, can have a substantial impact on the temperatures in each of the fresh food and freezer compartments. In order to return the freezer compartment to the set point temperature, the passageway interconnecting the fresh food and freezer compartments is closed off through operation of the damper. At this time, the freezer and fresh food compartment are isolated from one another. With this arrangement, the main cooling fan is operated to direct an airflow over the evaporator into the freezer compartment. Using this approach, the temperature rise in the freezer compartment can be compensated for in an efficient manner. Unfortunately, when the compartments are isolated one from the other, a temperature stratification can occur in the fresh food compartment due to lack of air circulation.

In order to address such temperature stratification situations, it has been proposed in the prior art to incorporate elaborate air ducting systems and/or a dedicated fan to circulate air within the fresh food compartment. In general, elaborate ducting arrangements not only significantly add to the overall cost of the refrigerator, but effectively limit the space available for storing food items. In connection with known fan arrangements, an airflow is generated whereby air is drawn into the fan and distributed back into the compartment. As such, a more uniform temperature distribution is established within the compartment. However, recirculating the same air within the compartment is not without drawbacks. For instance, contaminants, in the form of dust and the like, tend to settle on internal fan surfaces, only to be later distributed onto food items located within the fresh food compartment.

In addition, odors emanating from stored food can be circulated around the compartment, thereby crosscontaminating, altering the taste of, and otherwise negatively impacting the attractiveness of remaining food items. Certainly, problems associated with refrigerator odors are not new. There are a variety of products on the market which purport to eliminate odors released from food. For instance, in an attempt to eliminate odors, some consumers place open boxes of baking soda within the fresh food compartment, with the baking soda acting to absorb a portion of the odors released by the food. Other consumers use commercial air fresheners to either cover up, or absorb food odors. Regardless of these arrangements, unless the full airflow can be treated, odors within the compartment will not be eliminated.

Regardless of these prior art attempts to address potential temperature stratification and odor problems in a food storage compartment of a refrigerator, there exists a need in the art for a fresh food compartment stirring fan assembly which is both capable of effectively minimizing compartment temperature gradients and accommodates filtering of a recirculated airflow.

SUMMARY OF THE INVENTION

The present invention is directed to a refrigerator air circulation and filtration system. More specifically, the invention is directed to an air circulation system used in connection with a refrigerator having at least a fresh food compartment within which is mounted a stirring fan. In accordance with one preferred form of the invention, a damper is arranged within a passageway to isolate the fresh food compartment from a freezer compartment during select cooling periods. Since the fresh food compartment is, at times, isolated from the freezer compartment, the stirring fan is operated to circulate the fresh food compartment air in order to maintain a substantially uniform temperature within the compartment. In accordance with another preferred form of the invention, the stirring fan is employed in connection with a fresh food compartment which is fluidly isolated from any freezer compartment.

In any case, in accordance with the most preferred embodiments, the stirring fan is mounted in a rear portion of the fresh food compartment. Preferably, the fan includes a removable cover having a central portion into which is drawn fresh food compartment air, and a peripheral portion, from which emanates a recirculated airflow within the fresh food compartment. In addition, a filter element is arranged beneath the cover at the central portion, such that incoming air can be treated to substantially eliminate odors and other airborne contaminants.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENTS

Figure 1:
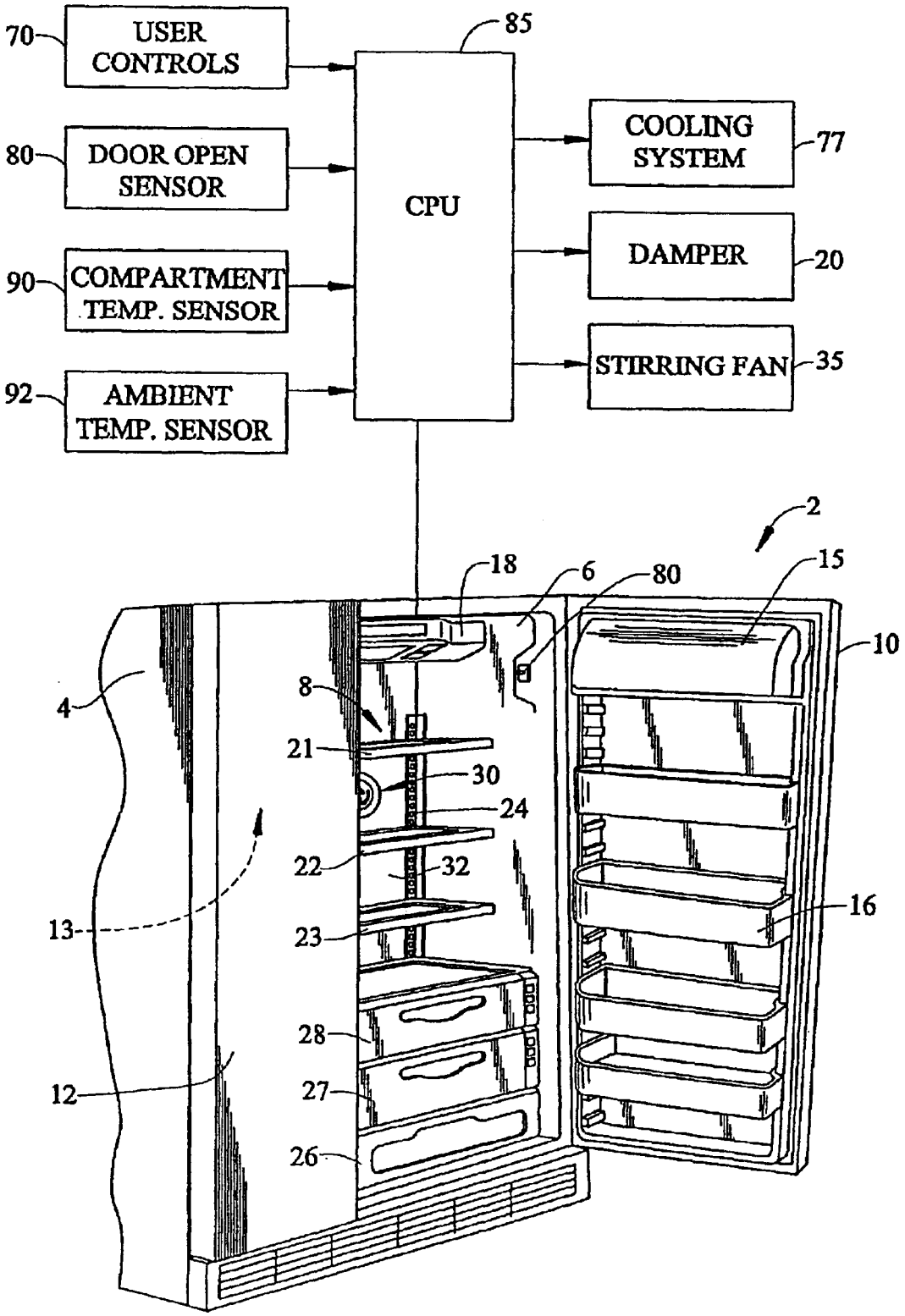
FIG. 1 is a partial, perspective view of a side-by-side refrigerator incorporating an air circulation and filtration system constructed in accordance with a first embodiment of the present invention.

With initial reference to FIG. 1, a refrigerator 2 includes a shell 4 within which is positioned a liner 6 that defines a fresh food compartment 8. In a manner known in the art, fresh food compartment 8 can be accessed by the selective opening of a fresh food door 10. In a similar manner, a freezer door 12 can be opened to access a freezer compartment 13. For the sake of completeness, door 10 of refrigerator 2 is shown to include a dairy compartment 15 and various vertically adjustable shelving units, one of which is indicated at 16.

Mounted in an upper region of fresh food compartment 8 is a temperature control housing 18 into which opens a passage 19 (see FIG. 3) fluidly interconnecting freezer compartment 13 with fresh food compartment 8. In a manner known in the art, a damper, schematically indicated at 20 in FIG. 1, is arranged within control housing 18 at passage 19 in order to regulate the temperature fresh food compartment 8 by allowing a select percentage of cooler air in freezer compartment 13 to be directed into fresh food compartment 8. Below temperature control housing 18 are arranged a plurality of vertically spaced shelves 21–23 which are preferably mounted for selective vertical adjustment upon rear rails, one of which is indicated at 24. At a lowermost portion of fresh food compartment 8 is illustrated various slidable bins, i.e., a lowermost bin 26 and higher, individually temperature controlled bins 27 and 28.

To this point, the above-described structure is known in the art and presented only for the sake of completeness. The present invention is actually directed to the incorporation of a fresh food compartment stirring fan assembly, which is generally indicated at 30, within fresh food compartment 8 of refrigerator 2. As will be detailed more fully below, stirring fan assembly 30 is mounted on a rear wall portion 32 of fresh food compartment 8 in order to reduce temperature stratification within fresh food compartment 8.

Figure 2:
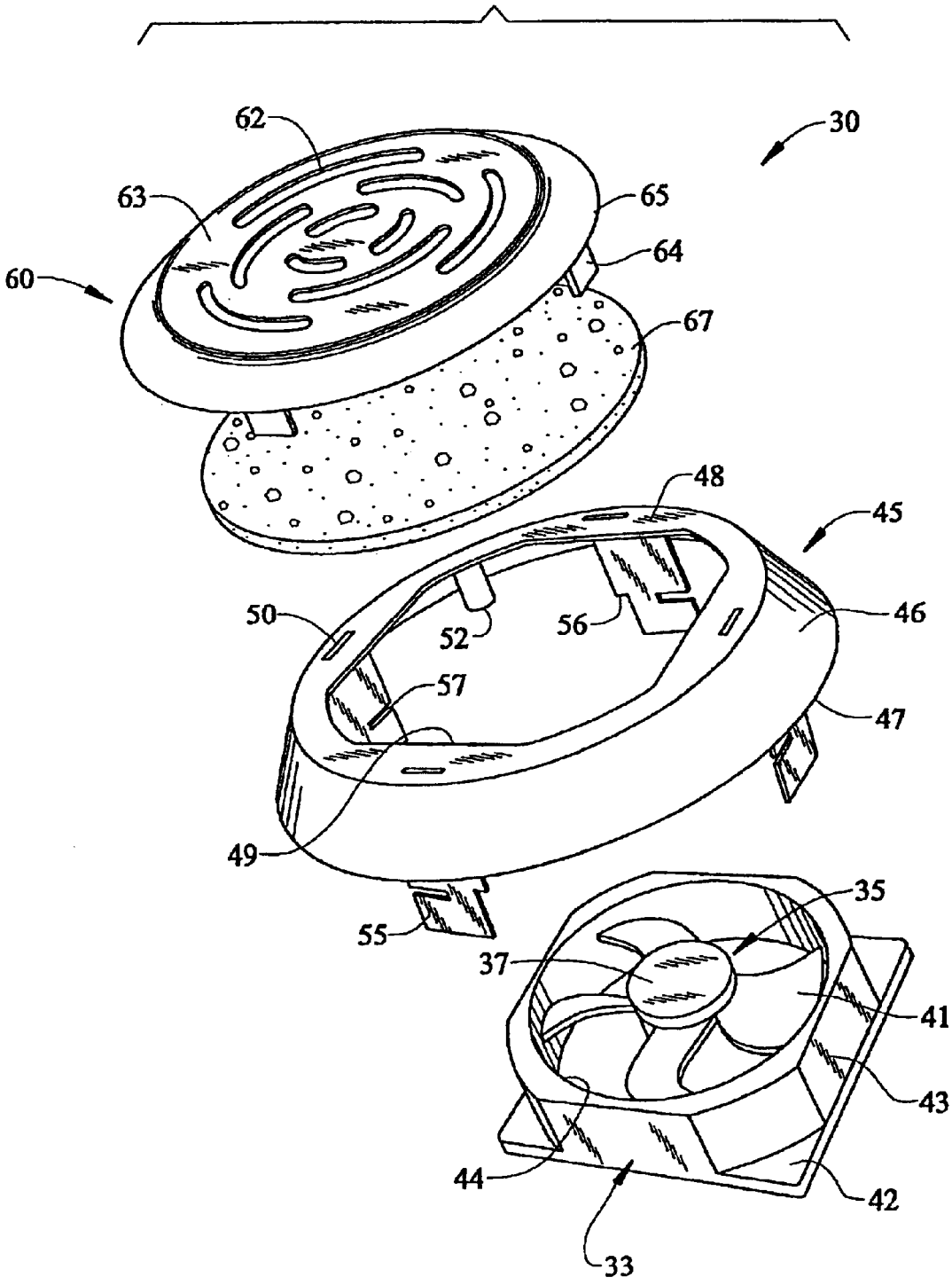
FIG. 2 is an exploded view of the air circulation and filtration system shown removed from the refrigerator of FIG. 1.

With reference to FIG. 2, stirring fan assembly 30 preferably includes a base member 33 which supports a fan 35. Fan 35 includes a central hub portion 37 which is connected to a drive motor (not shown).

Fan 35 includes a plurality of vanes 41 extending from central hub 37 and terminate short of base member 33. More specifically, base member 33 includes a base plate 42 and an upstanding, annular side wall 43 defining a central through hole 44 within which vanes 41 of fan 35 are rotatably arranged. Base member 33 is adapted to be mounted within a housing 45. In accordance with the most preferred embodiment of the invention, housing 45 includes a side wall portion 46 having an associated lower edge 47, and an upper central ledge portion 48 having a central opening 49. As shown, ledge portion 48 is preferably provided with a plurality of slots 50 at spaced peripheral locations.

Projecting downwardly from ledge portion 48 are spaced bosses, one of which is illustrated at 52 in FIG. 2. In the most preferred embodiment of the invention, four equally spaced bosses 52 are provided for use in connection with mounting base member 33 to housing 45, with vanes 41 being exposed directly below central opening 49. More specifically, bosses 52 are adapted to be attached to exposed portions of base plate 42, such as through the use of an adhesive, sonic welding, or mechanical fasteners (not shown). Housing 45 is further provided with a plurality of support or mounting elements 55, within the confines of which is mounted base member 33. As depicted, each support element 55 is preferably formed with a notched portion 56 and a juxtaposed slot 57 for use in mounting stirring fan assembly 30 within fresh food compartment 8. Although a preferred mounting arrangement will be discussed fully below, at this point, it should be noted that both notched portion 56 and slot 57 of each support element 55 are located further from ledge portion 48 than lower edge 47.

Stirring fan assembly 30 also includes a cover or cap 60 detachably mounted to ledge portion 48. More specifically, detachable cover 60 includes a plurality of inlet openings 62 arranged about an upper surface 63. A plurality of tabs 64 project from a peripheral portion 65 of cover 60. With this preferred arrangement, tabs 64 are adapted to be frictionally received within slots 50 arranged on ledge portion 48 of housing 45. Regardless of the particular mounting arrangement employed, cover 60 can be readily, selectively detached from housing 45. Also provided as part of stirring fan assembly 30 is a filter 67, such a foam or fiber insert, which is positioned within detachable cover 60. That is, filter 67 is either located entirely within cover 60 or against ledge portion 48. In either case, filter 67 is preferably maintained outside of housing 45. In this manner, filter 67 is arranged at an inlet of fan 35 such that contaminants carried by an incoming airflow are substantially removed prior to the airflow recirculating back into fresh food compartment 8.

In general, the cooling aspect of refrigerator 2 operates in a manner known in the art wherein a consumer operates at least one control setting element 70 provided on temperature control housing 18 to establish desired operating temperatures for freezer compartment 13 and fresh food compartment 8. Depending upon the relative temperature differences between desired set points and actual compartment temperatures, a cooling system 77 and damper 20 will be controlled. Typically, damper 20 is moved to a closed position to effectively isolate freezer compartment 13 from fresh food compartment 8 in order to shorten the time required to bring freezer compartment 8 to the desired temperature. On the other hand, the opening of damper 20 is regulated in order to establish a requisite amount of cooling air flowing from freezer compartment 13 to fresh food compartment 8 through passage 19. In this general fashion, refrigerated temperatures are established in each of fresh food and freezer compartments 8 and 13.

As freezer compartment 13 is maintained at a substantially lower temperature relative to fresh food compartment 8, cooling system 77 is operated more frequently to correct for temperature losses in freezer compartment 13. Since freezer compartment 13 is generally isolated from fresh food compartment 8 during these periods of correction, air maintained within fresh food compartment 8 can become stagnate. The stagnate air tends to cause the internal temperature within fresh food compartment 8 to stratify, i.e., a temperature gradient with regions of high and low temperatures develop within fresh food compartment 8. In order to substantially reduce temperature stratification, fan 35 is operated to recirculate air within fresh food compartment 8.

In accordance with this preferred embodiment of the invention, whenever fresh food compartment 8 is isolated from freezer compartment 13 through the closing of damper 19, stirring fan assembly 30 is operated. As indicated above, stirring fan assembly 30 is preferably mounted to rear wall portion 32 of liner 6 that defines fresh food compartment 8. In the preferred embodiment shown in FIGS. 1 and 3, stirring fan assembly 30 is actually positioned vertically between shelves 21 and 22. In the embodiment disclosed, this preferred mounting takes the form of providing slots (not shown) in liner 6 which are adapted to receive mounting elements 55 of housing 45 until the point where the various notched portions 56 abut liner 6. Each slot 57 preferably has a width dimension just slightly greater than the thickness of liner 6 such that housing 45, once positioned in this manner, can be rotated to secure stirring fan assembly 30 in the desired position. In any event, once mounted in this manner, it should be recognized that a gap will be created between liner 6 and housing 45. More specifically, there will be a fore-to-aft annular space between liner 6 and lower edge 47 of side wall portion 46. Of course, at this point, base member 33 including fan 35 is already fixedly mounted to housing 45 through bosses 52 as discussed above. The proper positioning of filter 67 and the attachment of cover 60 completes the overall assembly.

Figure 3:
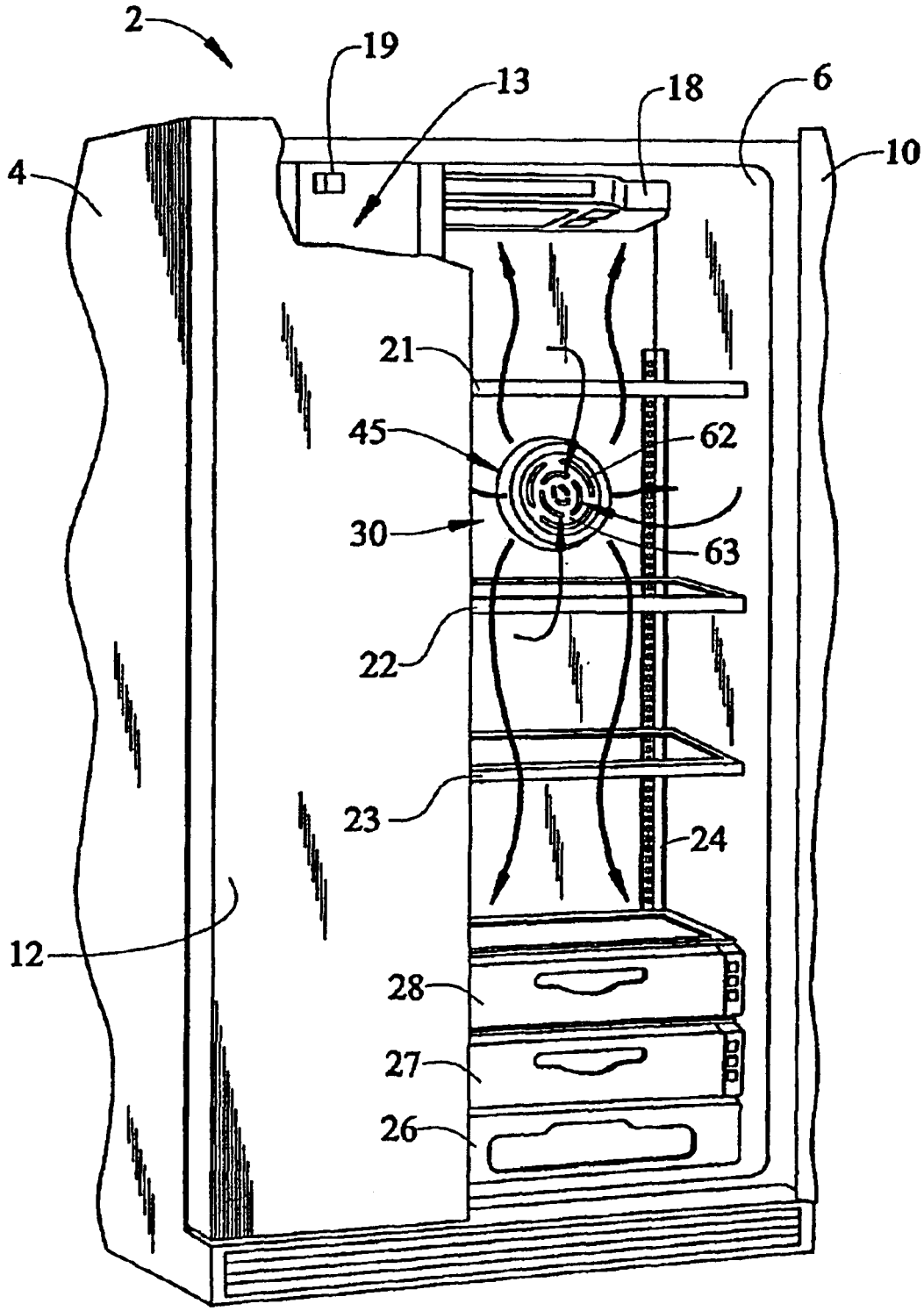
FIG. 3 is a partial, perspective view, generally similar to that of FIG. 1, illustrating air currents within the fresh food compartment of the refrigerator due to the air circulation and filtration system of the first embodiment of the present invention.

With this arrangement, during operation of stirring fan assembly 30, air is drawn into inlet openings 62 and directed through filter 67. The airflow past vanes 41 of fan 35 is forced radially outwardly in all directions through the gap or space between liner 6 and side wall portion 46 of housing 45. Therefore, as best shown in FIG. 3, the airflow from stirring fan assembly 30 leads in all directions along rear wall portion 32 of fresh food compartment 8. Once this airflow abuts obstructions, such as the various portions of liner 6, as well as temperature control housing 18 and bins 26–28, the airflow will be redirected. Eventually, this airflow leads back to inlet openings 62 such that a recirculation of the air is performed. Of course, as the air is re-circulated, it is forced through filter 67 prior to passing back into fresh food compartment 8. As indicated above, filter 67 is formed of a material designed to trap odor causing airborne particles. Therefore, the incorporation of stirring fan assembly 30 performs a dual function of reducing any potential temperature stratification within fresh food compartment 8 and also functions to reduce/eliminate odors and other contaminants within fresh food compartment 8.

In the preferred form of the invention represented in FIG. 1, fan 35 is regulated through CPU 85. Since fan 35 is particularly designed to recirculate air when fresh food compartment 8 is isolated from freezer compartment 13, fan 35 is preferably provided to operate at all times that damper 20 is closed or cooling system 77 is operated. However, in accordance with the most preferred embodiment of the invention, it is desired to de-activate fan 35 when door 10 is open. For this purpose, a door switch 80 is provided on liner 6 and adapted to be engaged by door 10 to signal CPU 85 when door 10 is open. Therefore, when door 10 is opened, an internal light (not shown) will be activated and the operation of fan 35 will be paused through CPU 85.

Also contemplated in accordance with the present invention is to have CPU 85 establish various operating modes for fan 35. For instance, CPU 85 can receive signals from one or more compartment temperature sensors 90 for use in regulating the activation/deactivation state, fan speed, percent run time, and a delay in starting of fan 35. More specifically, it is possible to employ multiple compartment temperature sensors 90 in various portions of fresh food compartment 8 to more accurately sense temperature gradients therein in order to either control the activation/deactivation state of fan 35 or, in the case of employing a variable speed motor, the operating speed of fan 35. The temperature sensors employed also preferably include an ambient temperature sensor 92. Within the scope of the invention, these signals can be used to operate fan 35 at a higher speed when there is a larger difference between the internal temperature of fresh food compartment 8 and the ambient temperature, given that the opening of door 10 will have a larger adverse effect on the overall temperature gradient. In any event, it should be readily apparent that CPU 85 can receive various signals to regulate the operation of fan 35 to efficiently maintain a substantially uniform temperature within fresh food compartment 8 with the inclusion of the stirring fan assembly 30 of the present invention, while also operating in a more conventional manner to provide a basic flow of cooling air into each of fresh food compartment 8 and freezer compartment 13.

Due to the inclusion of filter 67, odors carried by the air within fresh food compartment 8 will be, at least, substantially reduced. Therefore, the consumer will be provided with an enhanced, fresh smelling compartment arrangement without requiring the replacement of a box of baking soda or the like within fresh food compartment 8. As cover 60 is readily detachable from housing 45, filter 67 can be easily removed for washing or replacement as necessary.

Figure 4:
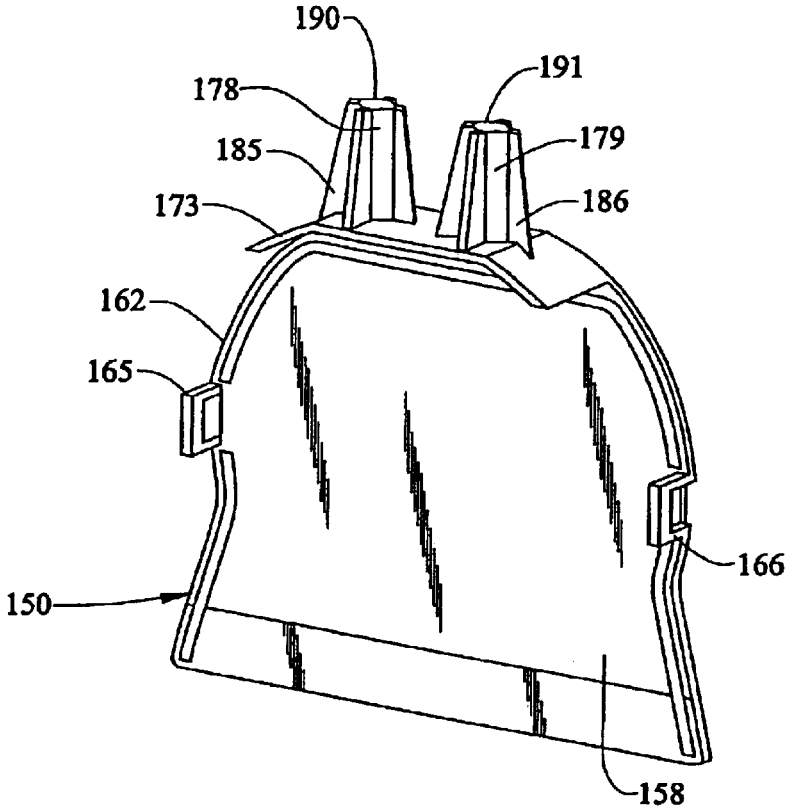
FIG. 4 is a perspective view of a first portion of a housing assembly constructed in accordance with a second embodiment of the present invention.
Figure 5:
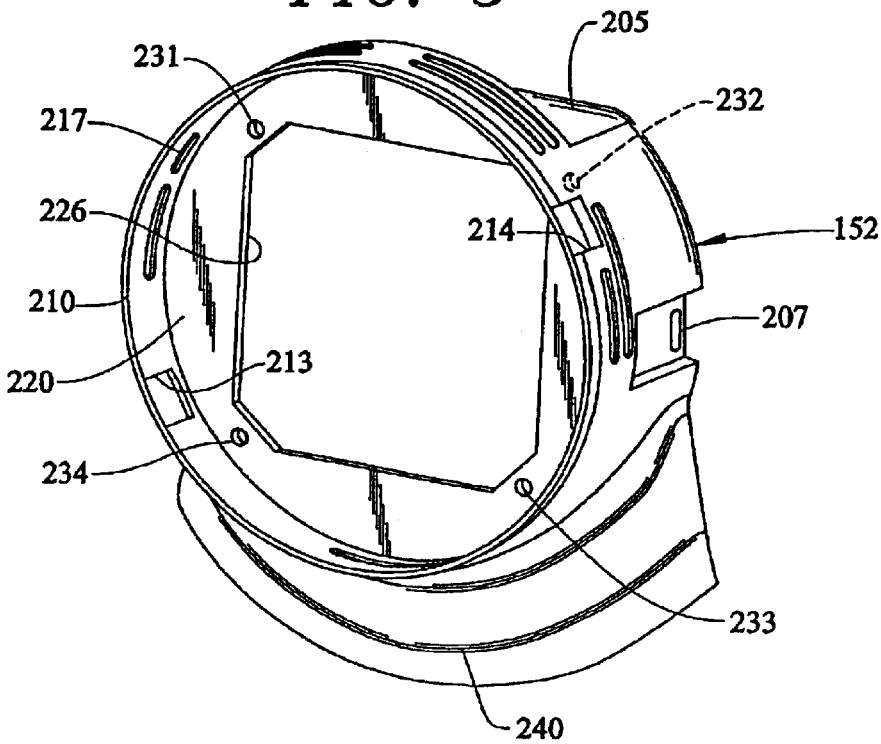
FIG. 5 is a perspective view of a second portion of the housing assembly constructed in accordance with the second embodiment of the present invention.

Although housing 45 has been described as being mounted to a substantially central rear surface of fresh food compartment 6, it should be understood that housing 45 could be mounted at other locations, particularly at an upper portion of fresh food compartment 6, such as directly beneath or at least partially behind control housing 18. Additional modifications can also be readily employed. For instance, FIGS. 4 and 5 illustrate a second embodiment of the present invention wherein a stirring fan assembly includes a housing base member 150 and a main housing 152. As shown, housing base member 150 includes a substantially planar base plate 158 having an upstanding peripheral side wall portion 162. As will be discussed more fully below, projecting perpendicularly from side wall portion 162 are first and second clip elements 165 and 166. Additionally, projecting perpendicularly from a top portion of side wall portion 162 is a top flange 173 which is formed with first and second mounting pins 178 and 179.

In accordance with this embodiment, mounting pins 178 and 179 are adapted to be received in respective bores formed at an upper portion of fresh food compartment 6, such as at least partially behind temperature control housing 18, or directly in temperature control housing 18. To this end, projecting from an exterior surface and extending along a longitudinal length of each mounting pin 178 and 179 are a plurality of fin elements indicated generally at 185 and 186. With this arrangement, mounting pins 178 and 179 can be inserted into respective receiving bores (not shown) with fin elements 185 and 186 providing an interference fit securing housing base member 150 within fresh food compartment 6. In addition, one or more mechanical fasteners (not shown) can be employed to secure housing base member 150 within fresh food compartment 6.

As best seen in FIG. 5, main housing 152 includes a main body portion 205 having arranged thereon opposing tab elements, one of which is indicated at 207. Tab elements 207 are adapted to engage into respective clip elements 165 and 166 arranged on housing base member 150 for snap-fittingly securing main housing 152 onto housing base member 150. As shown, extending from main body portion 205 is a cover receiving section 210, which as will be discussed more fully below, is adapted to have secured thereto a cover member. To this end, cover receiving section 210 preferably includes at least one pair of opposing cover mounting element receiving journals 213 and 214 defining openings that extend through cover receiving section 210. In addition, arranged about cover receiving section 210 are a plurality of vent openings 217 as will be more fully discussed below.

Positioned between main body portion 205 and cover receiving section 210 is a fan support web or ledge 220. As shown, fan support web 220 includes a central opening 226 and a plurality of fan mounting apertures 231–234 which, in accordance with this form of the invention, are adapted to receive a mechanical fastener for securing fan 35 to main housing 152. Finally, extending from a lower region of main body portion 205 is an outlet shroud 240. As will be discussed more fully below, in accordance with this form of the invention, shroud 240 is adapted to direct a recirculated airflow, which is drawn into fan 35 through cover 250, to various regions of fresh food compartment 6.

Figure 6:
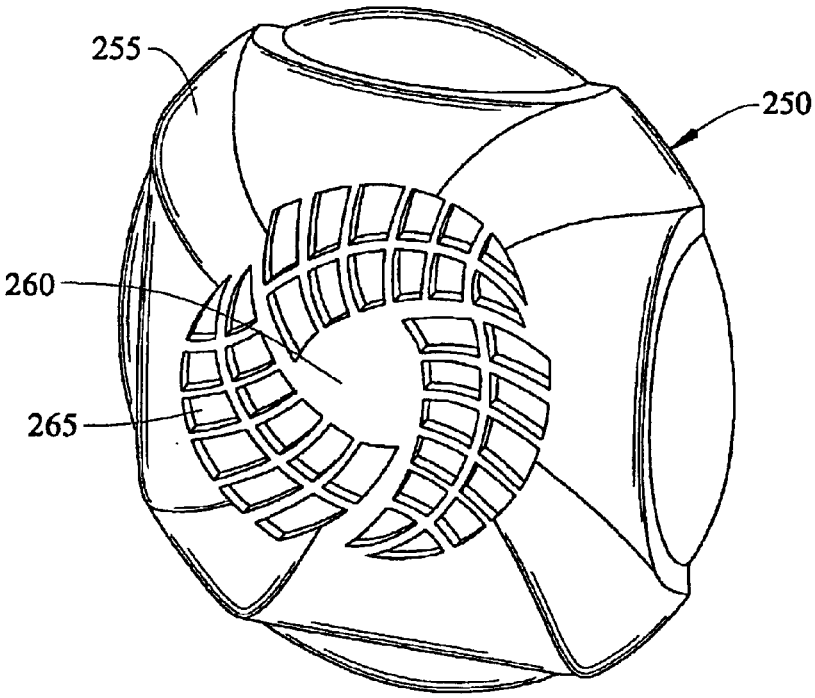
FIG. 6 is a perspective view of a housing cover constructed in accordance with one embodiment of the present invention.
Figure 7:
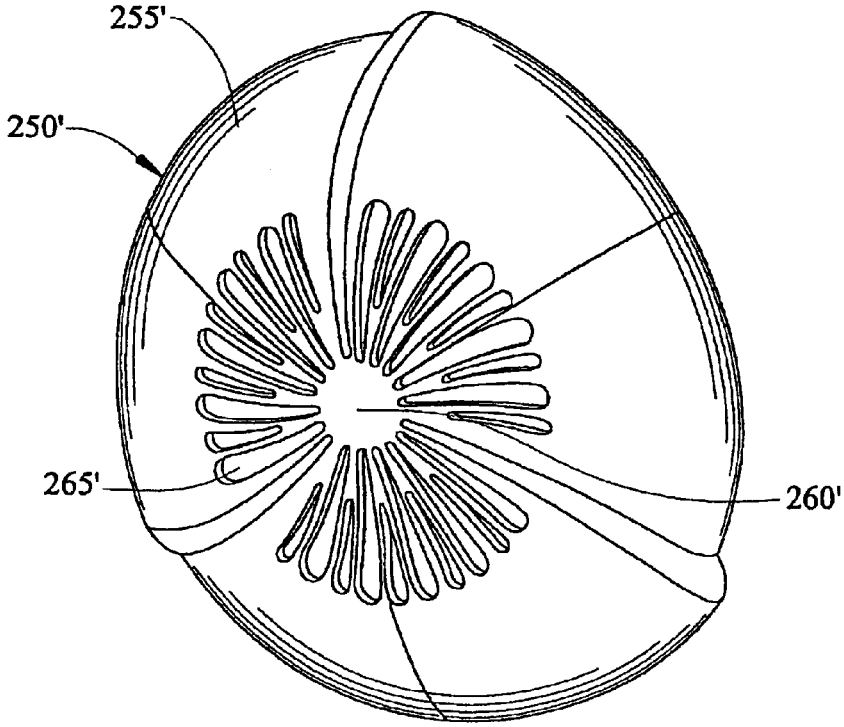
FIG. 7 is a perspective view of a housing cover constructed in accordance with another embodiment of the present invention.
Figure 8:
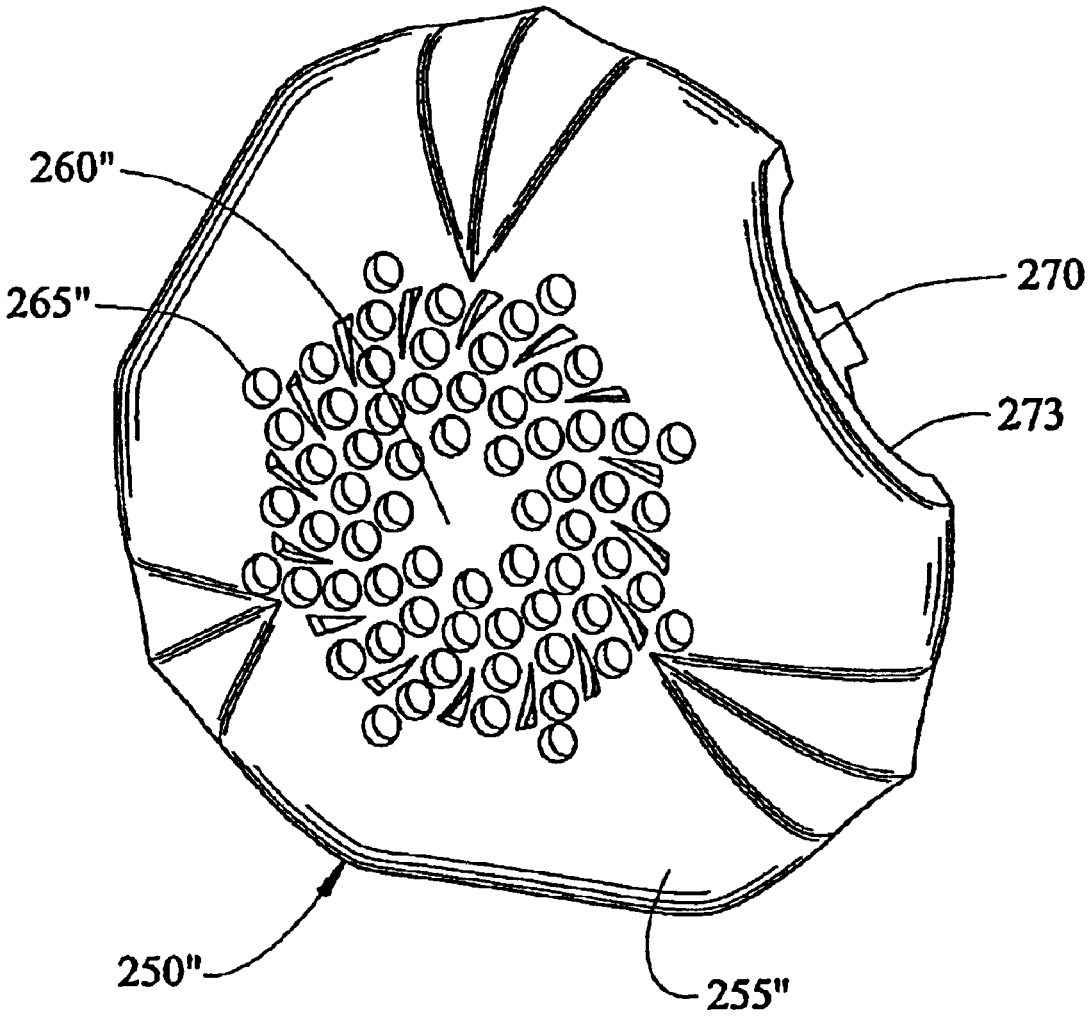
FIG. 8 is a perspective view of a housing cover constructed in accordance with a still further embodiment of the present invention.

As set forth above, secured to cover receiving section 210 of main body portion 205 is a vented cover 250 (see FIG. 6). As shown, cover 250 includes a main portion 255, a central portion 260 and a plurality of inlet openings 265 which are arranged in an arcuate pattern about central portion 260. In accordance with another form of the invention shown in FIG. 7, a cover 250' includes a main portion 255', a central portion 260' and a plurality of inlet openings 265' which extend radially outwardly from adjacent central portion 260'. Finally, referring to FIG. 8 which depicts yet another embodiment of the present invention, a cover 250" includes a main portion 255", a central portion 260" and a plurality of inlet openings 265" which generally take the form of circular apertures which are arranged about central portion 260". FIG. 8 also illustrates that cover 250" includes a tab element 270 projecting from a rear surface 273 of each respective cover portion. Tab element 270 is adapted to be snap-fittingly engaged with a respective one of tab elements receiving journals 213 and 214 for securing cover 250" onto main housing 152. Actually, two such opposing tab elements 270 are provided in cover 250", as well as each of covers 250 and 250' for corresponding purposes.

In accordance with the embodiments illustrated in FIGS. 4–8, during operation of stirring fan assembly 30, air is drawn into inlet openings such as exemplified by 265 in FIG. 6. The airflow past vanes 41 of fan 35 is forced outwardly and downwardly through the gap or space between liner 6 and a peripheral portion defined by shroud 240 of main housing 152. Therefore, the airflow from stirring fan assembly 30 leads downward in all directions along rear wall portion 32 of fresh food compartment 8. Once this airflow abuts obstructions, such as the various portions of liner 6 and bins 26–28, the airflow will be redirected. Eventually, this airflow leads back to inlet openings 265 such that a re-circulation of the air is performed. In addition, while not shown, it should be understood that a filter, such as described with respect to filter 67 may be incorporated into these present embodiments without requiring modification of the existing structure.

Although described with reference to preferred embodiments of the present invention, it should be readily understood that various changes and/or modifications can be made to the invention without departing from the spirit thereof. For instance, the filter element can be mounted either in an upstream or downstream portion of the overall fan assembly so long as air passing through the fan assembly is adequately filtered. Alternatively, the filter can be removed completely from the system. In addition, while the refrigerator described above incorporates an opening passing between the freezer compartment and the fresh food compartment, it should be understood by one of ordinary skill in the art that the present invention is equally applicable to refrigerators having a freezer compartment and a fresh food compartment isolated one from the other, or even a refrigerator only having a fresh food compartment. In general, the invention is only intended to be limited by the scope of the following claims.

We claim:

1. A refrigerator comprising:

a cabinet shell including a fresh food compartment and a freezer compartment;

a passage for fluidly interconnecting the fresh food compartment with the freezer compartment such that a flow of cooling air can flow from the freezer compartment to the fresh food compartment;

a damper provided in the passage, said damper being selectively movable between at least an open position and a closed position in order to control the flow of cooling air;

a cooling system for developing the flow of cooling air directed from the freezer compartment into the fresh food compartment when the damper is in the open position;

a fresh food stirring fan assembly mounted in the fresh food compartment for developing a recirculating airflow within the fresh food compartment, said fresh food stirring fan assembly including: a housing; a stirring fan positioned in the housing; a removable fan cover attached to the housing and disposed about the stirring fan; and a filter pad arranged between the fan cover and the stirring fan, said stirring fan assembly including a central portion through which a recirculating airflow is drawn, and a peripheral portion for redirecting the recirculating airflow back into the fresh food compartment, wherein operation of the stirring fan causes the recirculating airflow to pass through the filter in order to remove odors and other contaminants carried by the recirculating airflow; and a control unit for operating the stirring fan whenever the cooling system is de-activated and the damper is in the closed position to create a substantially uniform temperature within the fresh food compartment.

2. A refrigerator comprising:

a cabinet shell including at least a fresh food compartment;

a fresh food stirring fan assembly mounted in the fresh food compartment for developing a recirculating airflow within the fresh food compartment, said fresh food stirring fan assembly including: a housing; a stirring fan positioned in the housing; a fan cover attached to the housing and disposed about the stirring fan; and a filter pad arranged between the fan cover and the stirring fan, said stirring fan assembly including a central portion through which a recirculating airflow is drawn, and a peripheral portion for redirecting the recirculating airflow back into the fresh food compartment, wherein operation of the stirring fan causes the recirculating airflow to pass through the filter in order to remove odors and other contaminants carried by the recirculating airflow; and a control unit for operating the stirring fan to create a substantially uniform temperature within the fresh food compartment.

3. The refrigerator according to claim 2, wherein the housing includes a housing base member interconnected to a main housing through associated tab and receiving clip elements.

4. The refrigerator according to claim 2, further comprising at least one mounting element projecting from the housing, said at least one mounting element being adapted to secure the housing within the fresh food compartment.

5. The refrigerator according to claim 3, wherein the peripheral portion is defined by a shroud projecting from a lower region of the housing, said shroud being adapted to direct the recirculating airflow downwardly and outwardly into the fresh food compartment.

6. The refrigerator according to claim 2, wherein the fan cover is removable from the housing to directly expose the filter pad for replacement or cleaning purposes.

7. The refrigerator according to claim 6, wherein the filter is located entirely within cover.

8. The refrigerator according to claim 2, wherein the stirring fan includes a base plate, an annular side wall extending from the base plate and defining a central through hole, and a plurality of vanes positioned and rotatable within the central through hole of the annular side wall.

9. The refrigerator according to claim 8, wherein the housing includes a side wall portion and an ledge portion having a central opening, said stirring fan being arranged within the side wall portion and against the ledge portion of the housing.

10. The refrigerator according to claim 9, wherein the sidewall portion constitutes a cover receiving section which frictionally retains the cover.

11. The refrigerator according to claim 10, wherein the cover receiving section of the housing is formed with a plurality of spaced openings, said cover being removably connected to the housing at the spaced openings.

12. The refrigerator according to claim 11, wherein the cover is formed with a plurality of spaced tabs which are received in the spaced openings to removably attach the cover to the housing.

13. The refrigerator according to claim 10, wherein the cover is snap-connected to the housing.

14. The refrigerator according to claim 2, wherein the housing is provided with a plurality of support elements, said fresh food compartment being defined by a liner including a rear wall, said housing being mounted to the rear wall through the plurality of support elements.

15. The refrigerator according to claim 14, wherein each of the plurality of support elements is formed with a slot, said housing being mounted in the fresh food compartment, with a rear wall of the fresh food compartment extending into the slots.

16. The refrigerator according to claim 15, wherein each of the plurality of support elements is formed with a notched portion provided to establish a permissible degree of insertion of a respective one of the support elements into the rear wall.

17. A refrigerator comprising:

a cabinet shell including at least a fresh food compartment;

a cooling system for developing the flow of cooling air directed into the fresh food compartment;

a fresh food stirring fan assembly mounted in the fresh food compartment for developing a recirculating airflow within the fresh food compartment, said fresh food stirring fan assembly including: a housing; a stirring fan positioned in the housing; and a fan cover disposed about the stirring fan, said stirring fan assembly including a central portion through which a recirculating airflow is drawn, and a peripheral portion for redirecting the recirculating airflow back into the fresh food compartment; and a control unit for operating the stirring fan whenever the cooling system is de-activated in order to create a substantially uniform temperature within the fresh food compartment.

18. The refrigerator according to claim 17, further comprising: a plurality of sensors for signaling operational parameters of the refrigerator to the control unit, said control unit being adapted to further operate the stirring fan in one of a plurality of operational modes based upon signals received from the plurality of sensors.

19. The refrigerator according to claim 18, wherein the one of the plurality of operational modes is selected from the group consisting of: fan speed, percent run time, and start delay time.

20. The refrigerator according to claim 18, wherein the plurality of sensors includes an ambient temperature sensor.

21. The refrigerator according to claim 18, wherein the plurality of sensors includes a door opening sensor and a fresh food compartment temperature sensor.

22. The refrigerator according to claim 17, further comprising: a filter pad arranged between the fan cover and the stirring fan, wherein operation of the stirring fan causes the recirculating airflow to pass through the filter in order to remove odors and other contaminants carried by the recirculating airflow.

23. The refrigerator according to claim 22, wherein the fan cover is removable from the housing to directly expose the filter pad for replacement or cleaning purposes.

24. The refrigerator according to claim 17, further comprising:

a freezer compartment fluidly connected to the fresh food compartment by a passage; and a damper mounted within the passage, said damper being selectively movable between at least an open position, wherein cooling air flows from the freezer compartment to the fresh food compartment, and a closed position, wherein the cooling air flow is restricted.

25. The refrigerator according to claim 24, wherein the control unit de-activates the stirring fan when the damper is in the open position.

26. A method of establishing and maintaining a desired temperature within a fresh food refrigerator compartment comprising:

operating a refrigeration system to develop a desired level of cooling in the fresh food compartment;

de-activating the refrigeration system and activating a stirring fan assembly mounted in the fresh food compartment to initiate a flow of recirculating air in the fresh food compartment;

directing the flow of recirculating air through a filter pad of the stirring fan assembly to remove odors and other contaminants from the flow of recirculating air; and re-directing the flow of recirculating air, through a peripheral portion of the stirring fan assembly, into the fresh food compartment in a plurality of directions to minimize temperature stratification within the fresh food compartment.

* * * * *